US010925420B2

(12) United States Patent
Noble

(10) Patent No.: US 10,925,420 B2
(45) Date of Patent: Feb. 23, 2021

(54) ADJUSTABLE ERGONOMIC PILLOWS

(71) Applicant: Jamie Noble, Santa Cruz, CA (US)

(72) Inventor: Jamie Noble, Santa Cruz, CA (US)

( * ) Notice: Subject to any disclaimer, the term of this patent is extended or adjusted under 35 U.S.C. 154(b) by 255 days.

(21) Appl. No.: 16/166,842

(22) Filed: Oct. 22, 2018

(65) Prior Publication Data

US 2019/0116996 A1 Apr. 25, 2019

Related U.S. Application Data

(60) Provisional application No. 62/574,915, filed on Oct. 20, 2017.

(51) Int. Cl.
*A47G 9/10* (2006.01)

(52) U.S. Cl.
CPC ..... *A47G 9/1081* (2013.01); *A47G 9/109* (2013.01); *A47G 2009/1018* (2013.01)

(58) Field of Classification Search
CPC ..... A47G 9/10; A47G 9/1081; A47G 9/109
See application file for complete search history.

(56) References Cited

U.S. PATENT DOCUMENTS

| | | | | |
|---|---|---|---|---|
| 1,447,288 | A * | 3/1923 | Emmerich | A47G 9/10 5/645 |
| 4,874,340 | A * | 10/1989 | Smallwood | A47G 9/1045 446/28 |
| 5,016,303 | A * | 5/1991 | Tanaka | A47G 9/10 5/636 |
| 6,988,286 | B2 * | 1/2006 | Schecter | A47G 9/10 5/645 |
| D551,704 | S * | 9/2007 | Nakamura | D19/26 |
| 8,127,382 | B1 * | 3/2012 | Plascencia | A47G 9/0238 5/639 |
| 8,245,339 | B2 * | 8/2012 | Murray | A47G 9/10 5/657 |
| 2003/0226205 | A1 * | 12/2003 | Fishman | A47G 9/086 5/413 R |
| 2007/0174969 | A1 * | 8/2007 | Nakamura | B42D 1/008 5/640 |
| 2017/0020312 | A1 * | 1/2017 | Davis | A47G 9/10 |
| 2018/0344060 | A1 * | 12/2018 | Lee | A47G 9/10 |

* cited by examiner

*Primary Examiner* — Eric J Kurilla
(74) *Attorney, Agent, or Firm* — Donald R. Boys; Central Coast Patent Agency LLC

(57) ABSTRACT

A head pillow has an outer unit comprising two outer compartments with a common width and length, joined along a line in the length direction, each having an upper and a lower fabric wall and a closable opening providing access, and an inner unit with three separate compartments, joined side-by-side with a closable opening. Compartments are filled to a same or different thickness.

5 Claims, 9 Drawing Sheets

ADJUSTABLE ERGONOMIC PILLOWS

CROSS REFERENCE TO RELATED APPLICATIONS

The present application claims priority to provisional patent application 62/574,915, filed Oct. 20, 2017, and all disclosure of the parent application is incorporated at least by reference.

BACKGROUND OF THE INVENTION

1. Field of the Invention

The field and technology of the invention is that of sleeping apparatus.

2. Description of Related Art

In the art of sleeping apparatus at the time of filing the instant application, pillows typically cannot be adjusted in size, thickness or firmness. If a pillow does not seem to be perfect for the user, the only solution is to buy a new pillow. What is clearly needed is an ability for a user to quickly and easily personalize the pillow for their own sleeping preferences for height and firmness. Additionally, the ideal solution would allow the user to adjust the amount of filler material in each compartment separately. This would allow the user to customize their pillow to be thicker and firmer in certain parts of the pillow and less so in other parts of the pillow. Such a solution is not known in the art at the time of filing this application.

BRIEF SUMMARY OF THE INVENTION

In one embodiment of the present invention, a head pillow is provided, comprising an outer unit comprising two substantially planar and rectangular outer compartments with a common width and length, joined along a medial fold line in the length direction, each compartment having an upper and a lower fabric wall and a closable opening along a width edge providing access into volume between the upper and the lower fabric walls, and an inner unit comprising three separate rectangular inner compartments, joined side-by-side, each inner compartment having a closable opening along at least one edge, the three side-by-side compartments forming a rectangle of substantially the rectangular shape and size of one of the outer compartments of the outer unit. The three separate rectangular inner compartments of the inner unit are filled with a filler material to a same or different thickness for each of the three inner compartments, and the inner compartments are closed. The two outer compartments are filled to a same or a different thickness with a filler material, and closed, and the joined and filled inner compartments are placed on one of the outer compartments, and the other outer compartment is folded along the medial fold line over the joined inner compartments, and outer edges of the outer compartments are joined, enclosing the joined inner compartments, providing an ergonomic pillow.

In one embodiment the pillow further comprises separate inner sub-compartments within each of the outer compartments, the separate inner sub-compartments fillable to same or different thickness. Also, in one embodiment there are three side-by-side sub-compartments within each of the outer compartments. In one embodiment the filling of compartments is accomplished to thicknesses dictated by measurements of an individual, to support the individual's head and neck in a position natural to the individual. And in one embodiment filler material comprises one of or a blend of sheep's wool, cashmere, alpaca wool, silk, shredded foam rubber, and shredded imitation foam rubber.

In another aspect of the invention a triangular-shaped lower-body pillow is provided, comprising an upper and a lower triangular fabric panel joined along outer edges, seams joining the upper and lower fabric panels, forming a plurality of separate, fillable compartments, and closures along outer edges of the lower-body pillow, allowing access to the separate, fillable compartments. With the closure open, compartments are filled to a same or different thickness, and the closures are then closed.

In one embodiment corner seams are implemented across all three corners of the upper and lower fabric panels, creating corner pockets. Also, in one additional pockets are created with parallel seams, parallel to one of the three sides of the lower-body pillow, the parallel seams spaced apart and terminating at either edges of the lower-body pillow, or at corner seams. Also, in one embodiment the closures are zippers. And in one embodiment filler material comprises one of or a blend of sheep's wool, cashmere, alpaca wool, silk shredded foam rubber, and shredded imitation foam rubber.

DETAILED DESCRIPTION OF THE INVENTION

A very important feature of the invention is modular assembly of separate portions of a pillow, and use of multiple compartments, each accessible from outside the pillow or compartment, so that volume and resiliency of different parts of the pillow may be adjusted to the particular desires of a user, so the pillow may be personalized. The use of separate accessible pockets allows the user to experiment with different fill levels in different parts of the pillow. Having multiple volume compartments also allows the user to use a different filler material in each volume compartment, if the user so desires.

Figure 1:
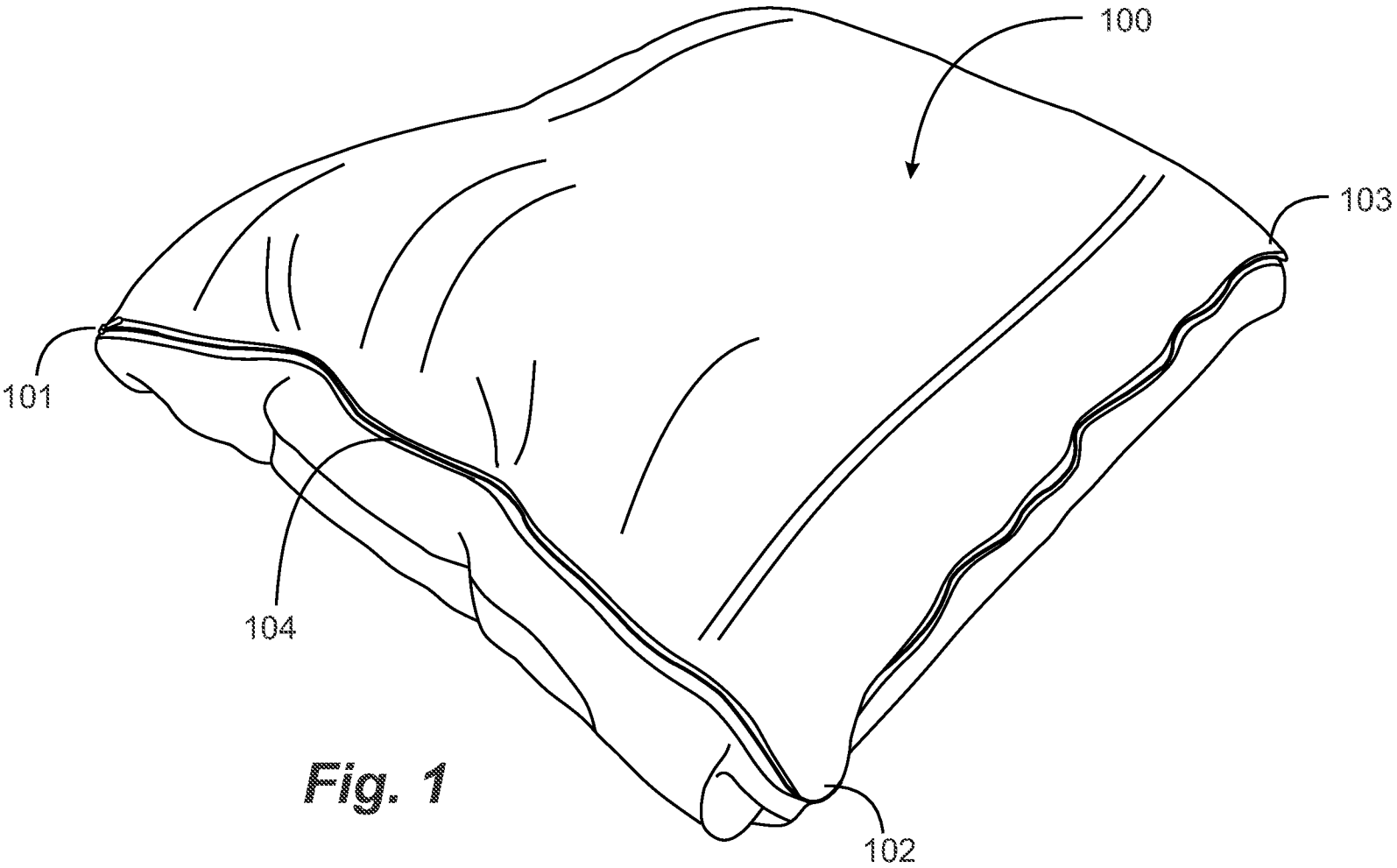
FIG. 1 is a perspective illustration of a head pillow in an enclosed state.

FIG. 1 is a perspective view of a compound head pillow 100, in one embodiment of the invention. FIG. 1 shows the head pillow 100 in a closed state. In this embodiment a closure mechanism 104, beginning at one corner 101, passes around corners 102 and 103, along three sides of the head pillow. In this embodiment of the invention, the closure mechanism is a zipper. Other closure mechanisms may be used in other embodiments, such as hook and loop fasteners or buttons.

Figure 2:
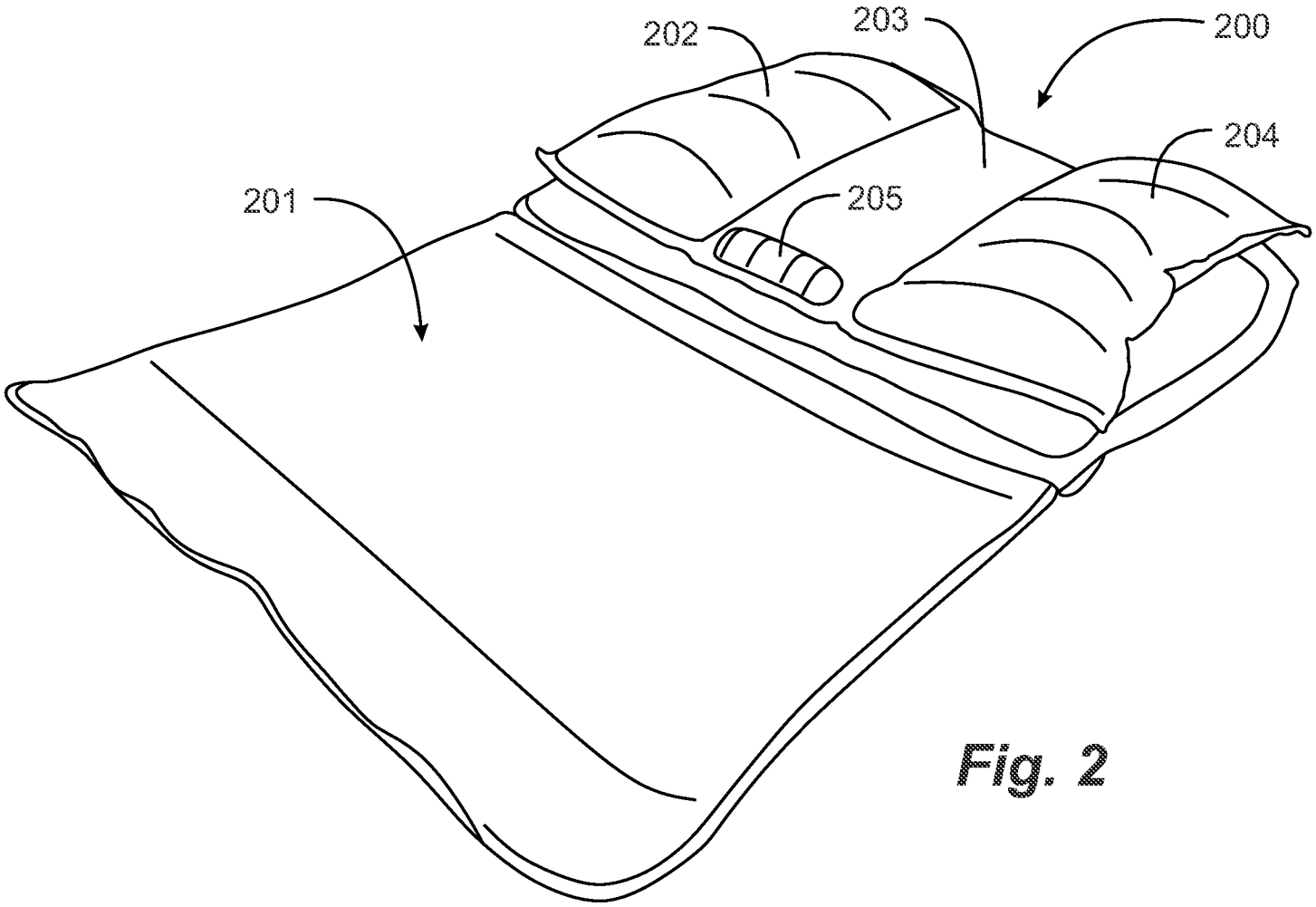
FIG. 2 shows the head pillow in an opened state.

FIG. 2 is another perspective view of head pillow 100 which displays the head pillow in an opened state. The opened state is achieved by opening the closure mechanism that runs around three sides of the pillow, and folding the outer panels apart. FIG. 2 illustrates an inner unit 200 that is utilized for shaping the assembled pillow, and an outer unit 201 that encloses the inner unit when folded and closed by closure 104.

Removable and adjustable inner unit 200 is designed to enable the user to add or remove filling material to and from three distinct pockets in the unit, adjusting the height and firmness of the overall pillow in the three separate and distinct pockets.

In one embodiment inner pillow 200 has three separate compartments 202, 203 and 204, enabling the user to add or remove filler material from each compartment to adjust the height and firmness of each portion of the pillow. Access to the separate compartments of inner pillow 200 is described below with reference to FIG. 4. In one embodiment a user will lay the head over compartment 203, and compartments 202 and 204 will be to either side of the user's head. In one embodiment there is a small compartment 205 between compartments 202 and 204, across one edge of inner pillow 200. In use, this compartment would lie directly beneath the user's neck, and supports the neck.

Figure 3:
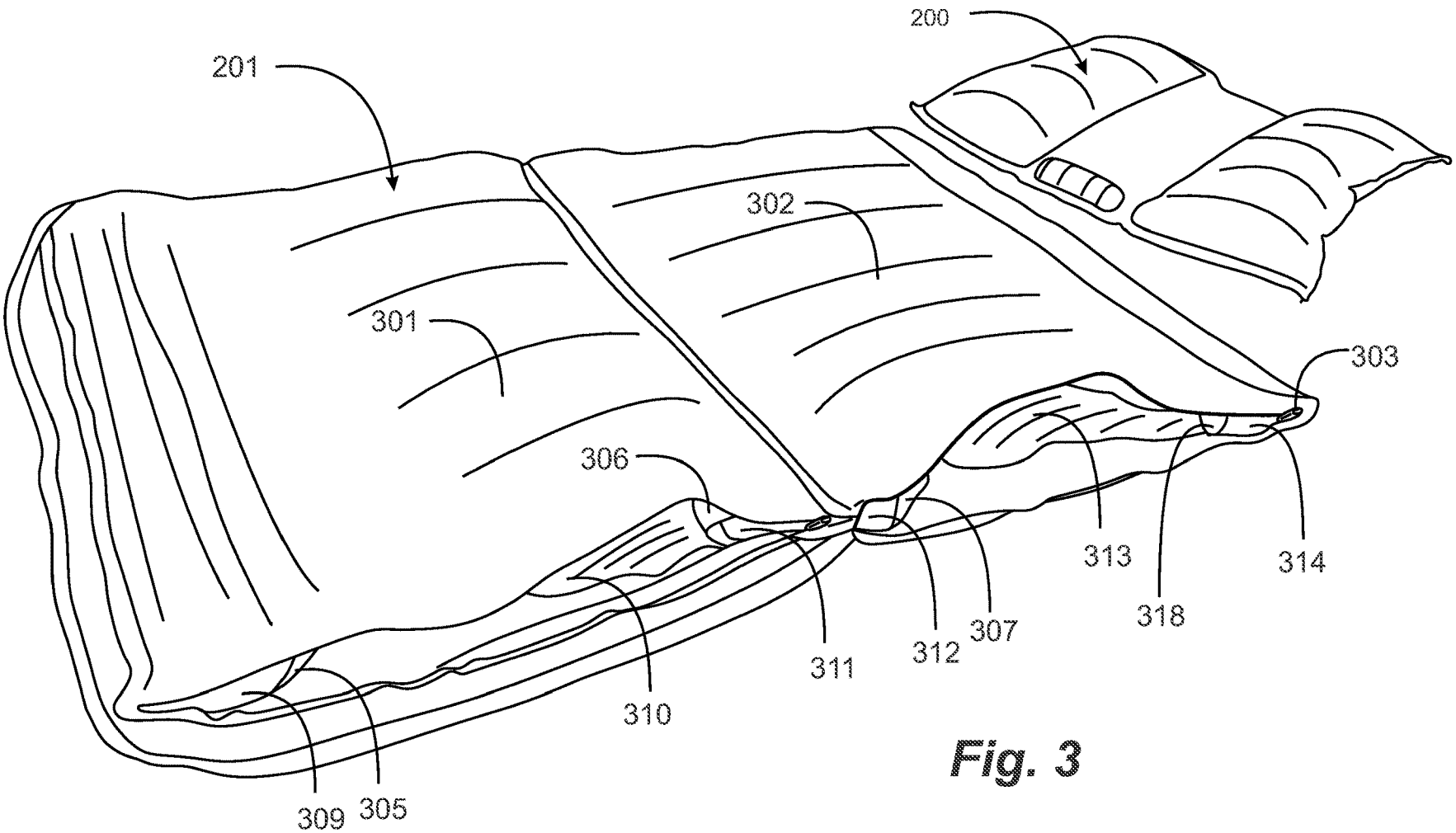
FIG. 3 is another perspective view of the head pillow in the opened state, displaying six inner volumes where filler material may be added or removed by a user.

FIG. 3 is a perspective view of outer unit 201 in its opened state, displaying six inner volumes. An inner fabric panel 301 extends the full length and width of one-half of the inner unit, and an inner fabric panel 302 extends the full length and width of the other half of the inner unit. These fabric panels are sewn on three sides, and each have a closure mechanism along the fourth side. The closure mechanisms 303 and 304 each extend the full width of one-half of the pillow. The closure mechanisms in this embodiment of the invention are zippers.

Four inner panels 305, 306, 307 and 308 are sewn to the outer and inner fabric panels across the full width of the outer unit, panels 305 and 306 in the half covered by inner fabric panel 301, and 307 and 308 in the half covered by inner fabric panel 302. These inner panels in one embodiment separate each half of the inner unit into three distinct volumes.

The inner panels 305 through 308 divide the two halves of the outer unit into six separate volumes, volumes 309, 310 and 311 in one half, and volumes 312, 313 and 314 in the other half. Each of the six compartments may be packed with a filler material that may be seen in the figure in individual ones of the compartments. The compartments may, in various embodiments, be of different width.

There are different types of filler materials to be used depending on the needs of the user. Wool is a common filler material. Other embodiments of the invention may use cashmere, alpaca and silk, and in another embodiment shredded foam rubber may be used. Some pillows may have different filler material in the different compartments. A user may need or prefer wool with more spring but are sensitive to the touch. In that case, they can have the top layer that is closest to skin filled with cashmere, silk, or alpaca, then alpaca/wool blend or whatever in core (next layer down) then at very bottom coarse but supportive wool. There are a variety of options.

Figure 4:
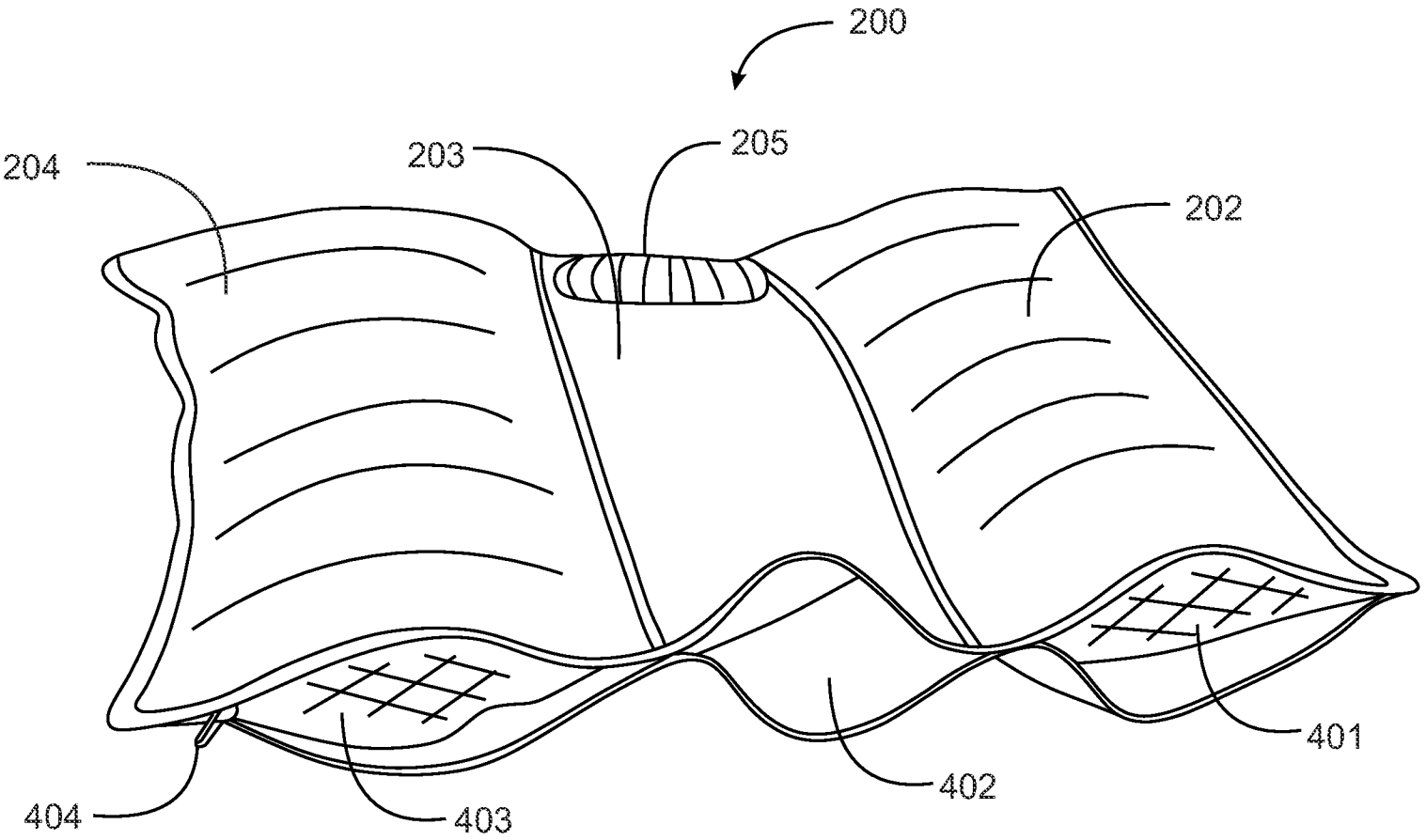
FIG. 4 is a perspective of a removable and adjustable inner unit as part of the head pillow.

FIG. 4 displays one perspective view of the removable and adjustable inner unit 200. The inner unit is designed to allow the user to add or remove filler material adjusting the height and firmness of the pillow in three separate and distinct volumes 401, 402 and 403, within compartments 202, 203 and 204. Again, there are a variety of filler materials that may be used, depending on the circumstances, and on the desires of the user. It will also be apparent to the skilled person that the variations in height and firmness of the inner unit will be experienced, not directly, but through the characteristics of the outer unit, described above with reference to FIG. 3.

FIG. 4 shows inner pillow 200 with the three compartments 401, 402 and 403 opened up, by virtue of opening a closure mechanism 404 that extends across the full width of the inner unit. Closure mechanism 404, in this embodiment, is a zipper, but may, in other embodiments be another sort of closure.

With the compartments open, filler material may be seen in the two outer pockets, but there is no filler material in the middle pocket. As described above, for other compartments, this may vary according to a user's preference. Also, as mentioned before, there are different types of filler materials depending on the needs or preferences of the user. In this example biodegradable material may be used to stuff the pillow. Wool is a common filler material. Other embodiments of the invention may use cashmere, alpaca and silk and another embodiment may use shredded foam rubber. Some pillows may have different filler material in the different sections. A user may need or prefer wool with more spring but might be sensitive to the touch. In that case, they can have the top layer that is closest to skin filled with cashmere, silk, or alpaca, then alpaca/wool blend or some other material in core (next layer down) then at very bottom, coarse but supportive wool.

Figure 5:
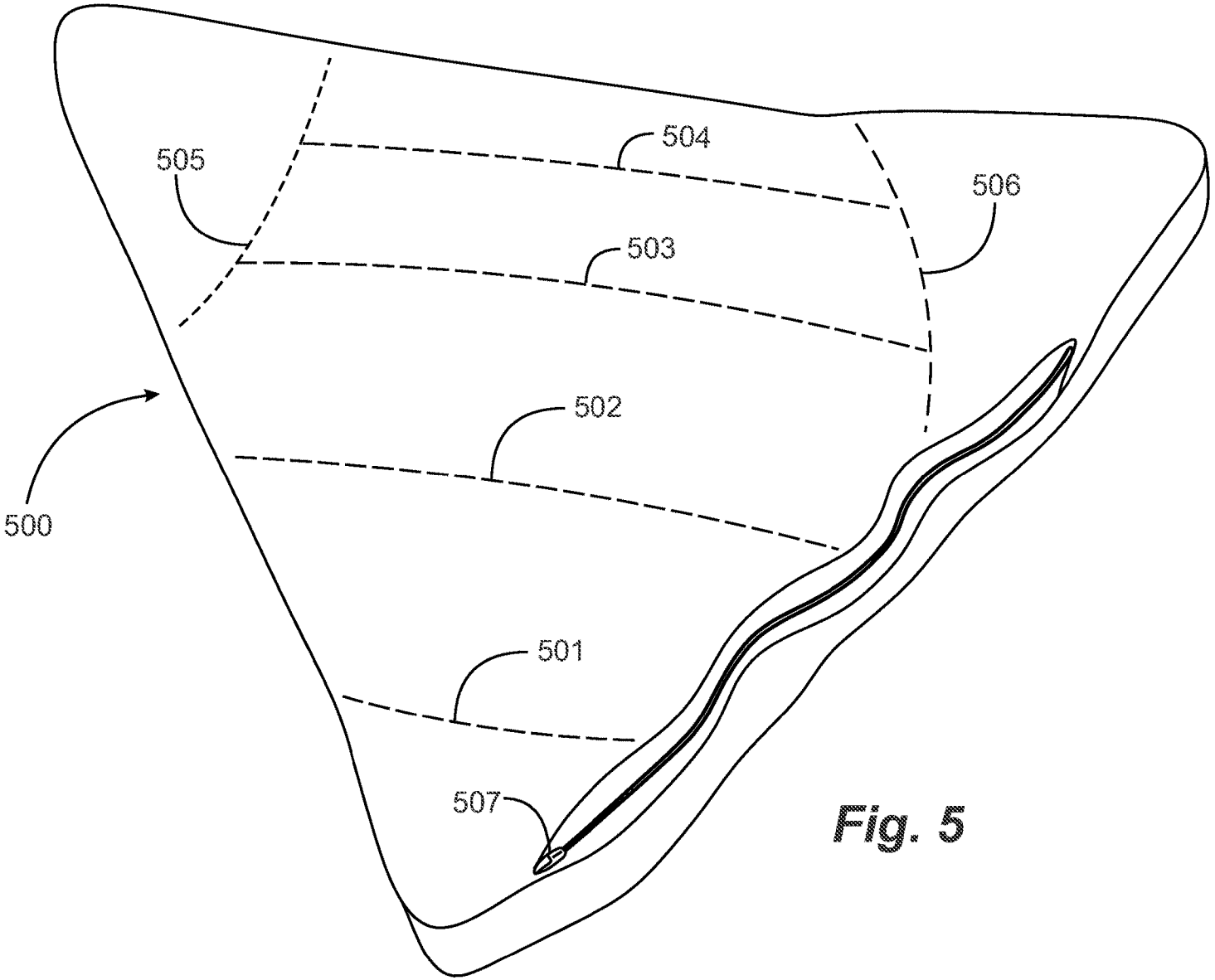
FIG. 5 is a perspective view of a body pillow in triangular shape.

In another aspect of the invention a body pillow 500 is provided for use with the lower body and legs. FIG. 5 displays body pillow 500 in perspective. In one embodiment, as shown in FIG. 5, the body pillow has seven compartments. Dotted lines have been added to the figure to indicate the approximate location of six seams, 501 through 506, where the upper and lower fabric may be sewn together to form the seven compartments in this example. In alternative embodiment, inner panels may be sewn between the upper and lower fabric panels, along the seam lines shown, to form the inner compartments. The number of pockets may be different in other embodiments, and the location of seams may also be different. For example, the corner compartments may be divided each into two compartments, so there would be a total of nine compartments. A closure mechanism 507, in this example a zipper, is shown along a portion of one side of the body pillow, to provide access to the compartments for adjusting amount of filler in the pockets. There may, in some embodiments, be more closure mechanisms to give further access to compartments.

Figure 6:
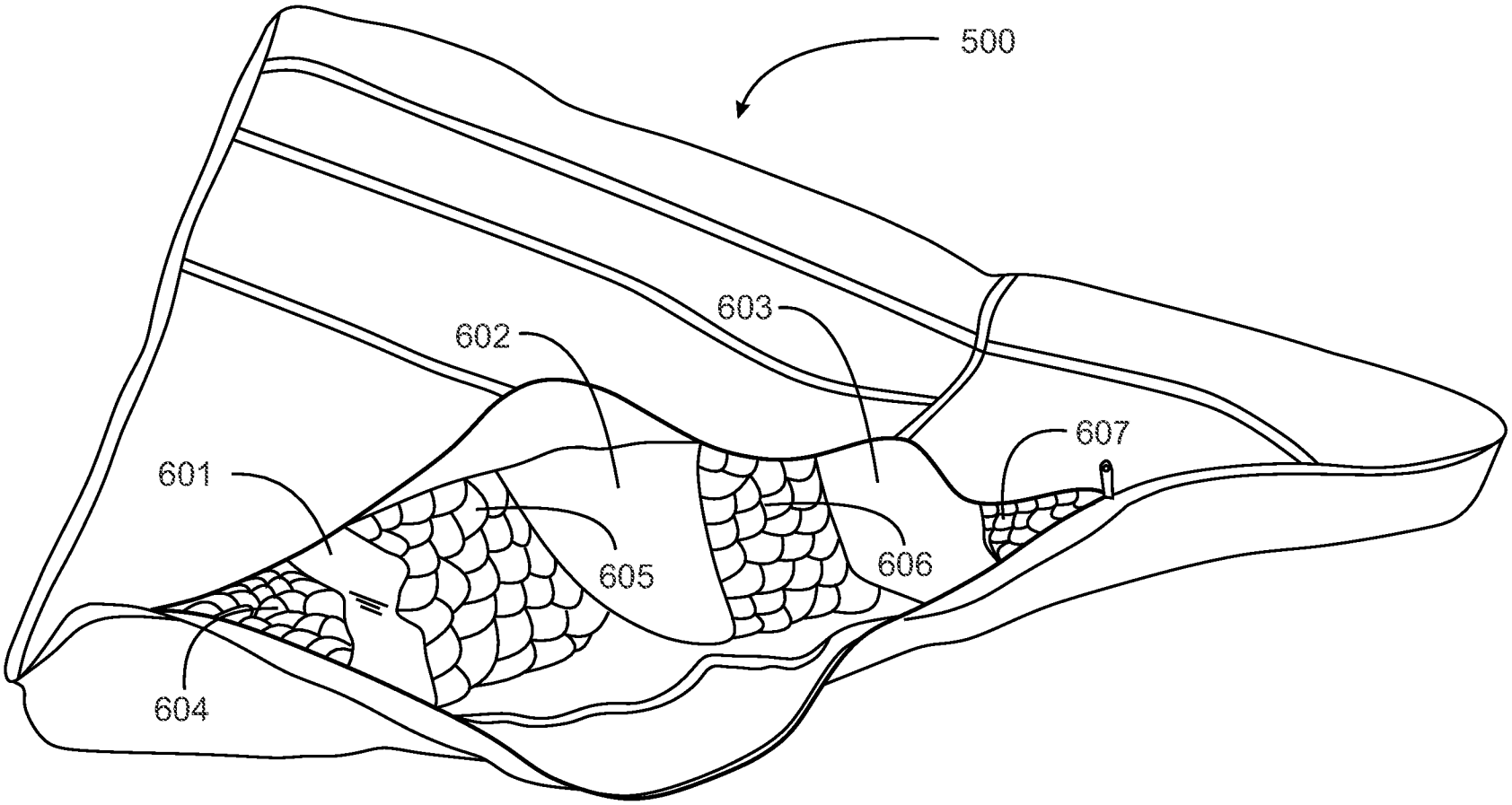
FIG. 6 shows the body pillow, with a closure mechanism in opened state.

FIG. 6 is a perspective view of the body pillow of FIG. 5, with zipper 507 open, providing access to at least some the compartments within. In this example, compartments are separated by inner panels such as panels 601, 602 and 603. In this particular example, compartments 604, 605, 606 and 607 are filled with wool, but, as described above, a variety of different filler materials might be utilized.

Figure 7:
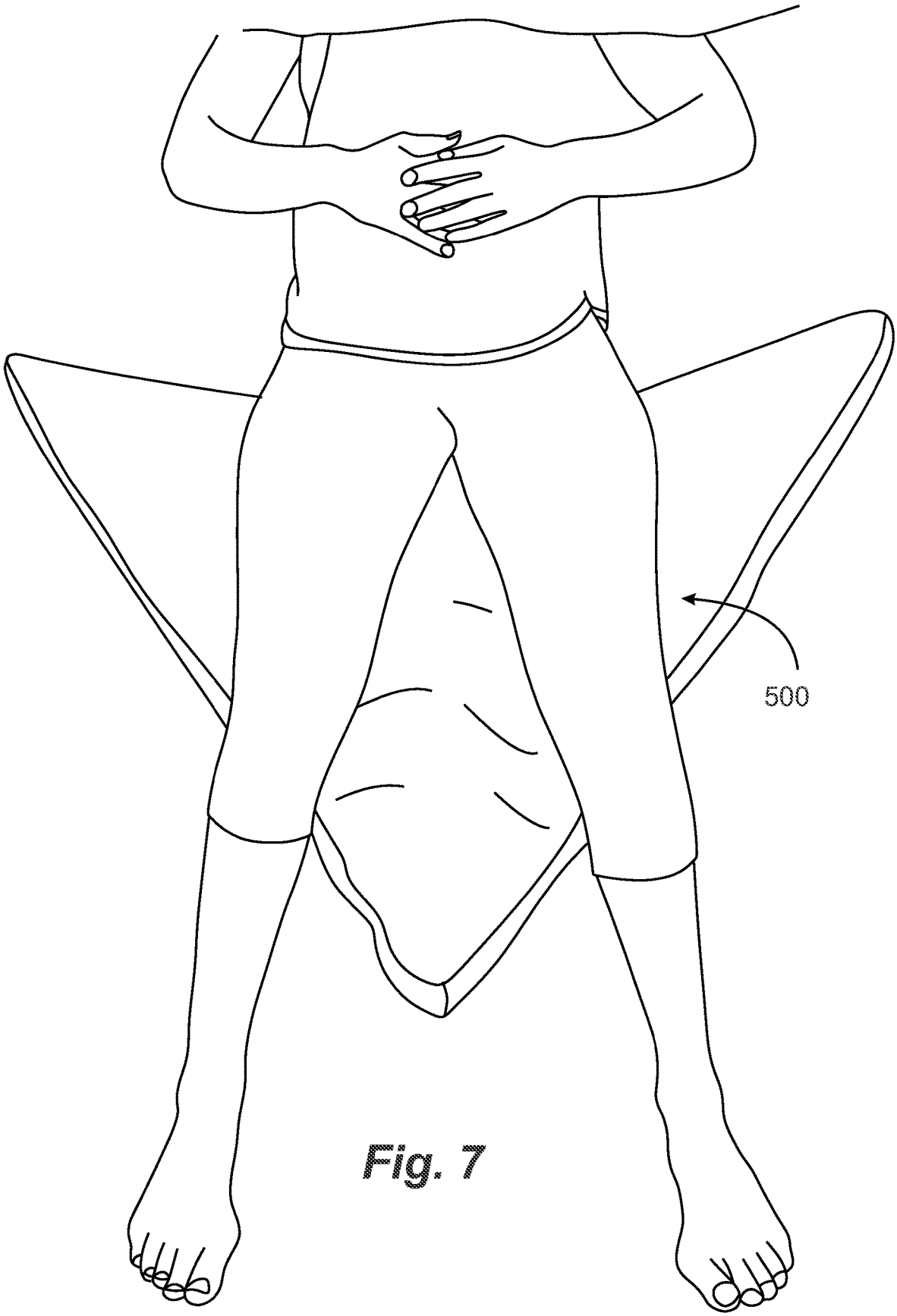
FIG. 7 illustrates a body pillow in use in an embodiment of the invention, with a user lying on her back.

FIG. 7 is a view showing a person sleeping on the back, using a body pillow 500 according to an embodiment of the invention, to support the hips and upper legs.

Figure 8:
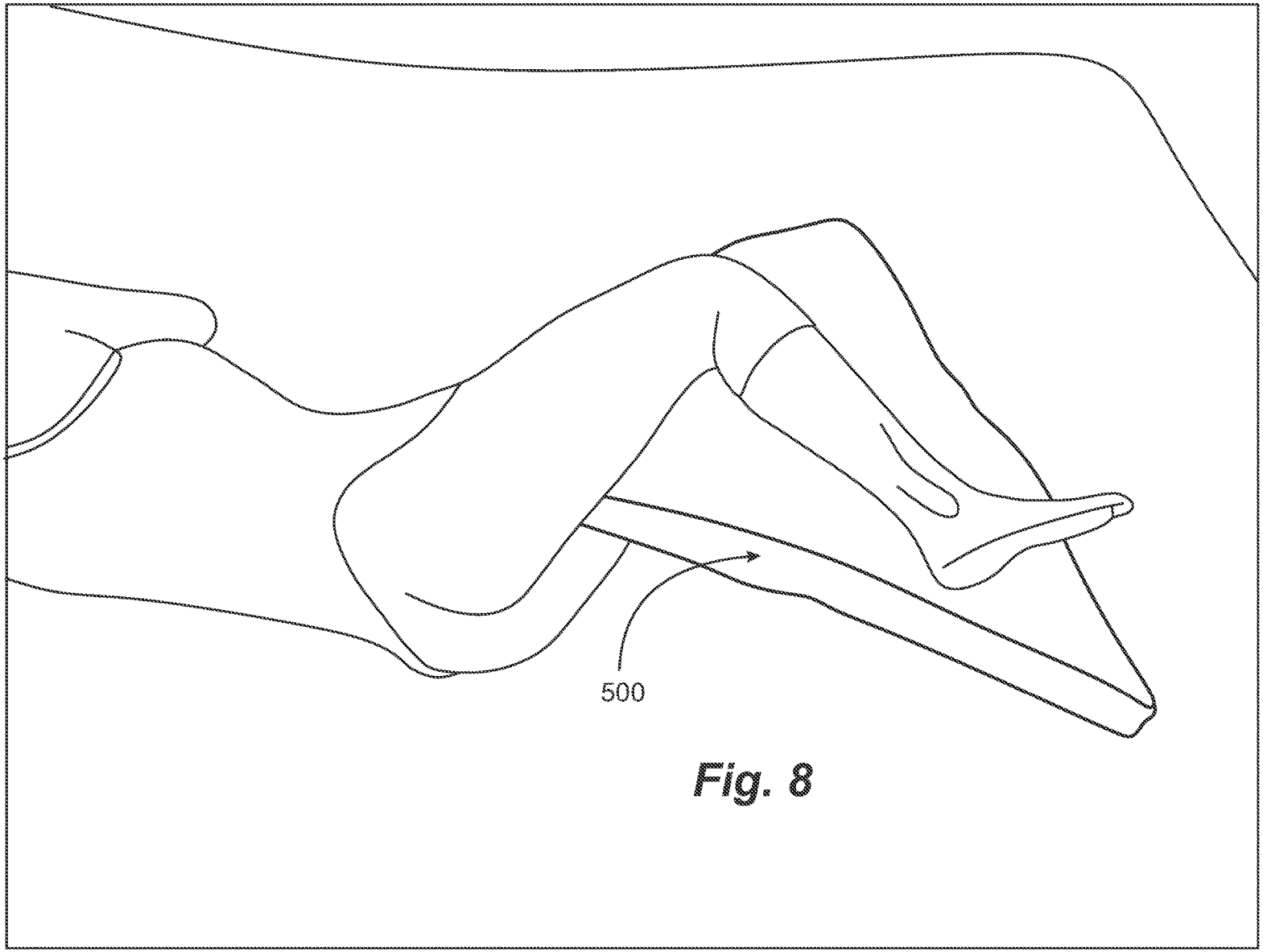
FIG. 8 illustrates a body pillow in use in an embodiment of the invention, with a user lying on her side.

FIG. 8 is a view showing the same person sleeping on one side, using the body pillow between the legs.

Figure 9:
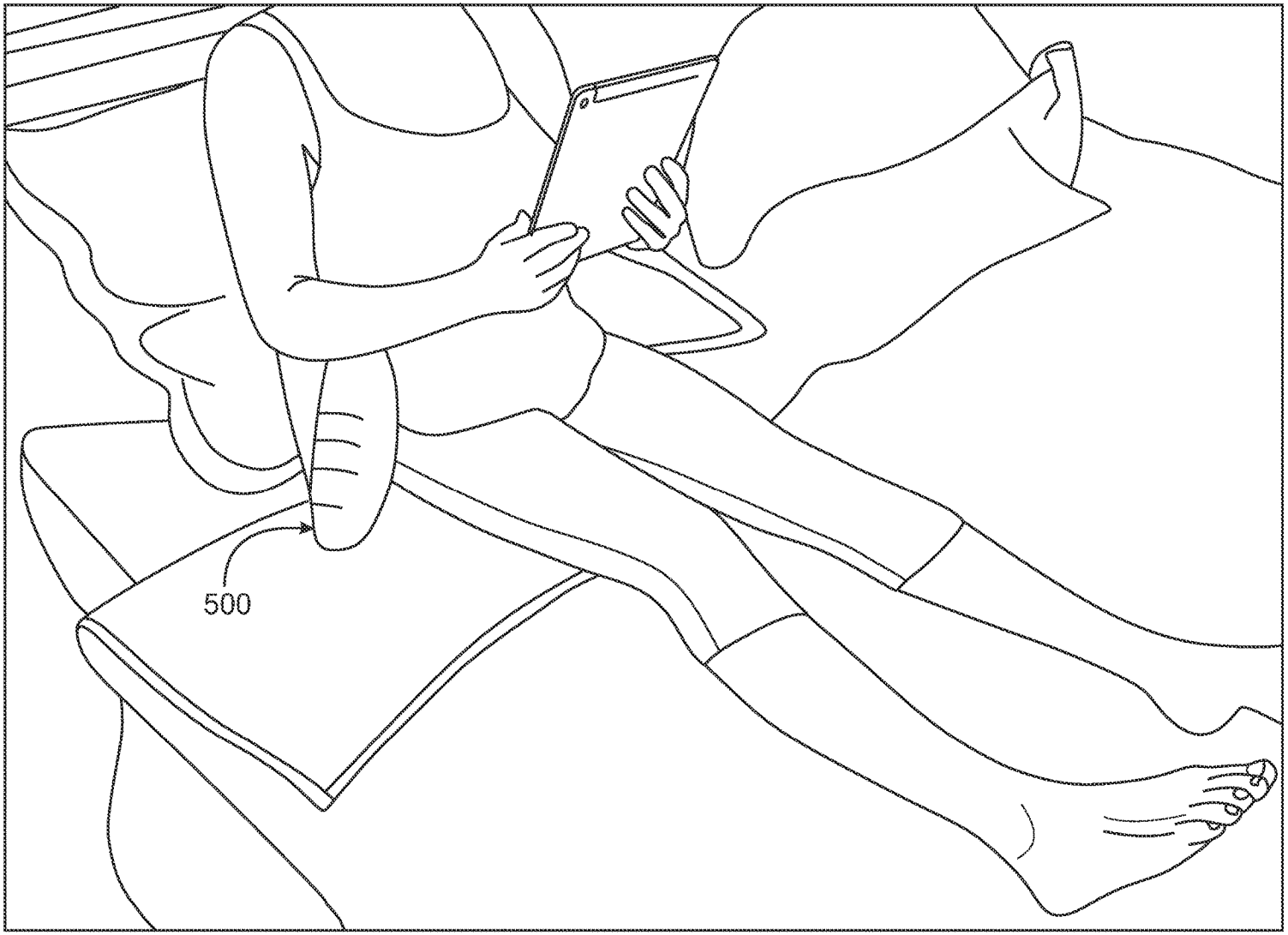
FIG. 9 illustrates a body pillow in use in an embodiment of the invention, with a user sitting up.

FIG. 9 is a view showing the same person sitting up, using the body pillow behind the back, with wing compartments folded forward on each side of the body.

In some embodiments of the invention pillows are created specifically for individuals, based on measurements specific to the individual. This service provides a pillow that fits the needs of the subject, based on various shapes and measurements, to best fit the subject, just as a suit of clothes or a garment might be tailored to a specific person.

In one embodiment an individual's measurements art taken as follows:

The circumference of the head is measured and recorded

With the individual standing with right shoulder against a wall, distance from the wall to the head in front of the ear is measured and recorded. Distance from the wall to the side of the neck is also measured and recorded The measurements to side of head and neck are repeated with the left shoulder against the wall With the individual's back to the wall and heels touching, measurement to the back of the head and to the back of the neck from the wall are measured and recorded Curvature length of the neck from the upper vertebrae to the back of the head is measured and recorded These measurements are considered when constructing a pillow, considering the surface of the wall as the surface of a mattress upon which the individual may use the pillow under construction. Individual pillows may thus be made to match the measurements for a user, so the user may be supported in a natural position, rather than a distorted position in use.

It will be apparent to the skilled person that there are a variety of changes that might be made in the embodiments illustrated and described in this application, without departing from the spirit and scope of the invention. Sizes may vary, as well as number and location of compartment, and access to compartments. Filling materials may also vary, and different materials may be used in different compartments. There are many such variations in different embodiments.

I claim:

1. A head pillow, comprising:

an outer unit comprising two substantially planar and rectangular outer compartments with a common width and length, joined along a medial fold line in the length direction, each compartment having an upper and a lower fabric wall and a closable opening along a width edge providing access into a volume between the upper fabric wall of one of the outer compartments and the lower fabric wall of the other outer compartment; and an inner unit comprising three separate rectangular inner compartments, joined side-by-side, each inner compartment having a closable opening along at least one edge, the three side-by-side compartments forming a rectangle of substantially the rectangular shape and size of one of the outer compartments of the outer unit;

wherein the three separate rectangular inner compartments of the inner unit are filled with a filler material to a same or different thickness for each of the three inner compartments, and the inner compartments are closed;

wherein the two outer compartments are filled to a same or a different thickness with a filler material, and closed; and wherein the joined and filled inner compartments are placed on one of the outer compartments, and the other outer compartment is folded along the medial fold line over the joined inner compartments, and outer edges of the outer compartments are joined, enclosing the joined inner compartments, providing an ergonomic pillow.

2. The head pillow of claim 1 further comprising separate inner sub-compartments within each of the outer compartments, the separate inner sub-compartments fillable to same or different thickness.

3. The head pillow of claim 2 having three side-by-side sub-compartments within each of the outer compartments.

4. The head pillow of claim 1 wherein the filling of compartments is accomplished to thicknesses dictated by measurements of an individual, to support the individual's head and neck in a position natural to the individual.

5. The head pillow of claim 1 wherein filler material comprises one of or a blend of sheep's wool, cashmere, alpaca wool, silk, shredded foam rubber, and shredded imitation foam rubber.

* * * * *